United States Patent [19]

Necoechea

[11] 4,354,066

[45] Oct. 12, 1982

[54] RIGID-DIAPHRAGM TRANSDUCER WITH PLURAL COILS

[76] Inventor: Robert W. Necoechea, 8609 DeSoto, Apt. 306, Canoga Park, Calif. 91304

[21] Appl. No.: 186,942

[22] Filed: Sep. 15, 1980

Related U.S. Application Data

[63] Continuation-in-part of Ser. No. 42,837, May 29, 1979, abandoned.

[51] Int. Cl.[3] ..... H04R 7/14

[52] U.S. Cl. ..... 179/115.5 DV; 179/115.5 PV; 181/173

[58] Field of Search ..... 179/115.5 DV, 115.5 PV, 179/115.5 VC, 115.5 R, 115 V, 115 R, 181 R; 181/173

[56] References Cited

U.S. PATENT DOCUMENTS

| | | | |
|---|---|---|---|
| 1,934,184 | 11/1933 | Gerlach et al. | 179/115.5 PV |
| 3,198,890 | 8/1965 | Rich | 179/115.5 PV X |
| 3,636,278 | 1/1972 | Heil | 179/115.5 PV |
| 3,711,659 | 1/1973 | Bremseth | 179/115.5 VC |
| 3,832,499 | 8/1974 | Heil | 179/115.5 PV |

*Primary Examiner*—Thomas W. Brown

*Attorney, Agent, or Firm*—Richard W. Keefe; David G. Parkhurst

[57] ABSTRACT

A rigid surface transducer of the electroacoustic type more commonly referred to as an audio speaker. The transducer comprises an improved diaphragm and driver configuration and improved excitation modes. The improved features employ a rigid diaphragm which is driven in a coherent linear type motion.

31 Claims, 36 Drawing Figures

FIG.4C
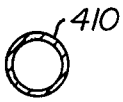
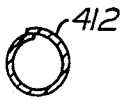
FIG.4D
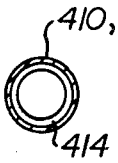
FIG.4E
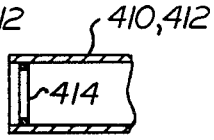
FIG.4F
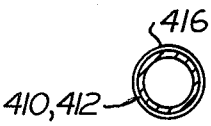
FIG.4G
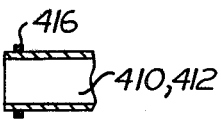
FIG.4H
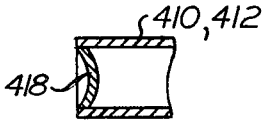
FIG.4I
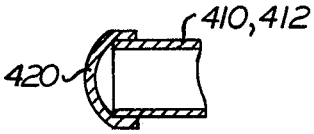
FIG.4J
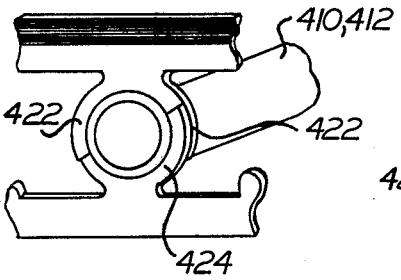
FIG.5C
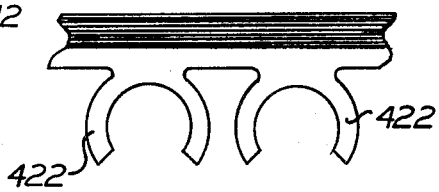
FIG.5D
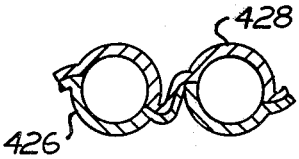
FIG.4K
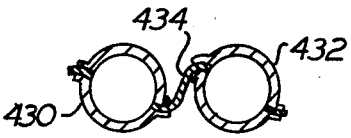
FIG.4L
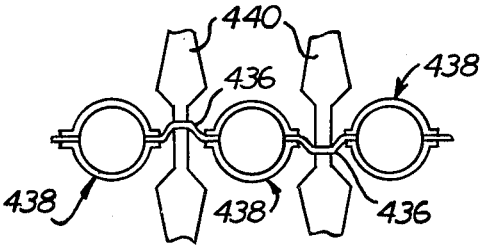
FIG.4M FIG. 5B
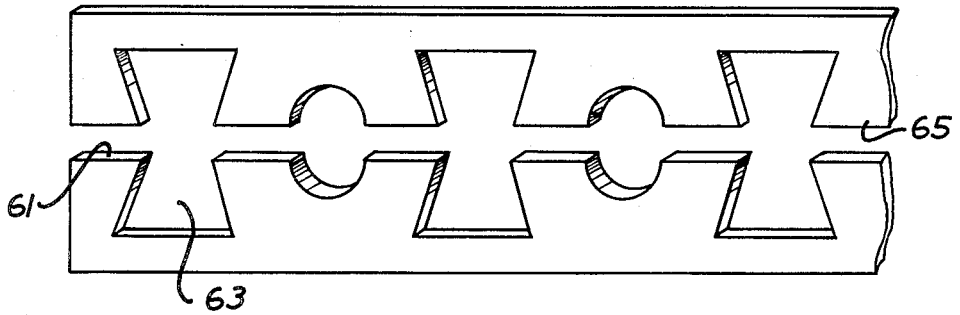
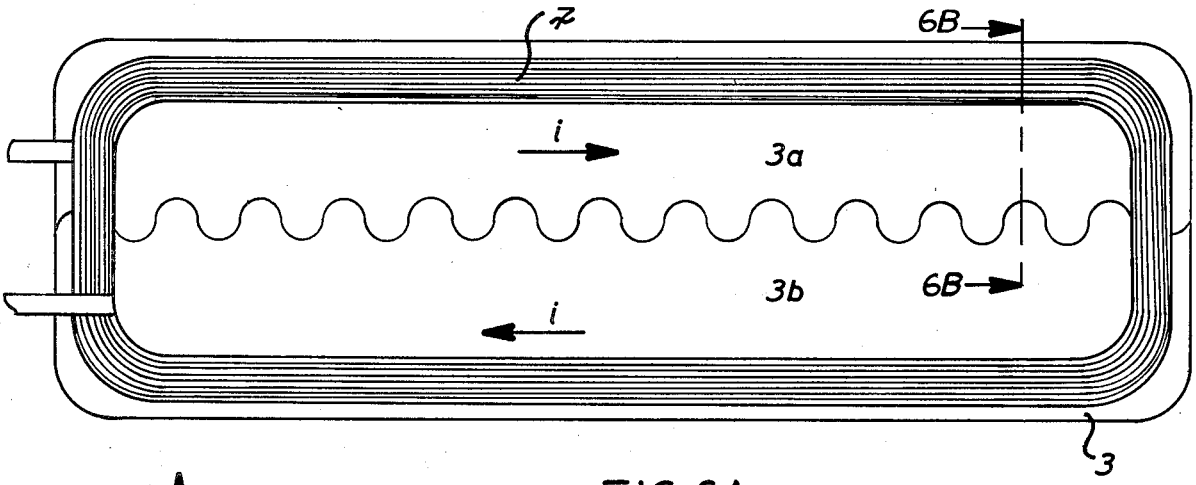
FIG. 6A
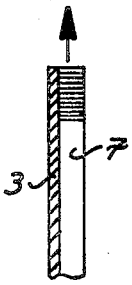
FIG. 6B
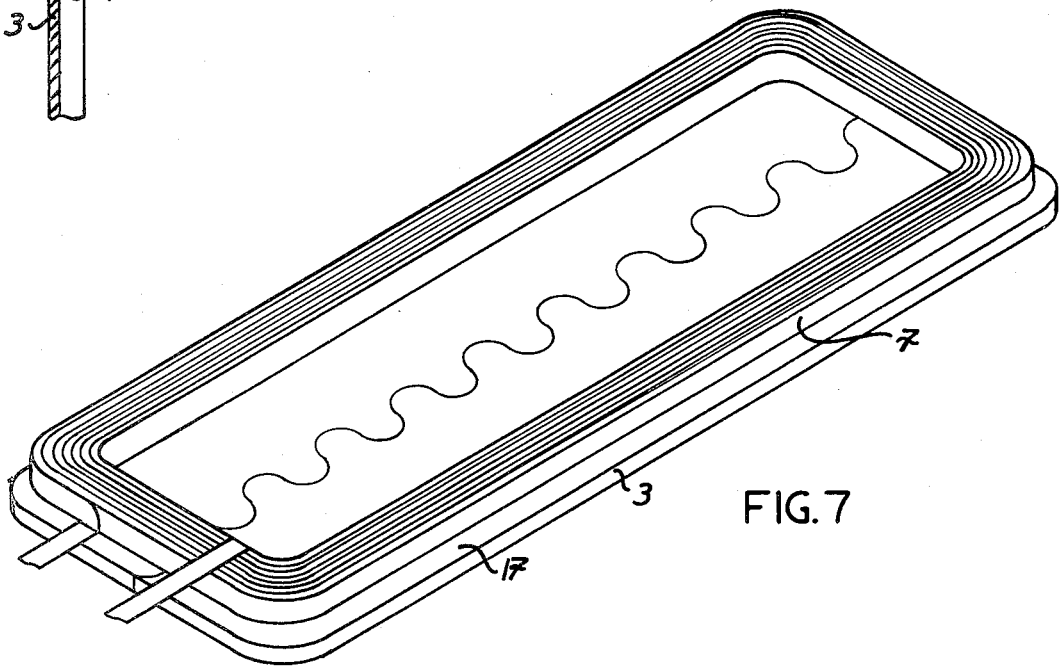
FIG. 7

FIG. 8
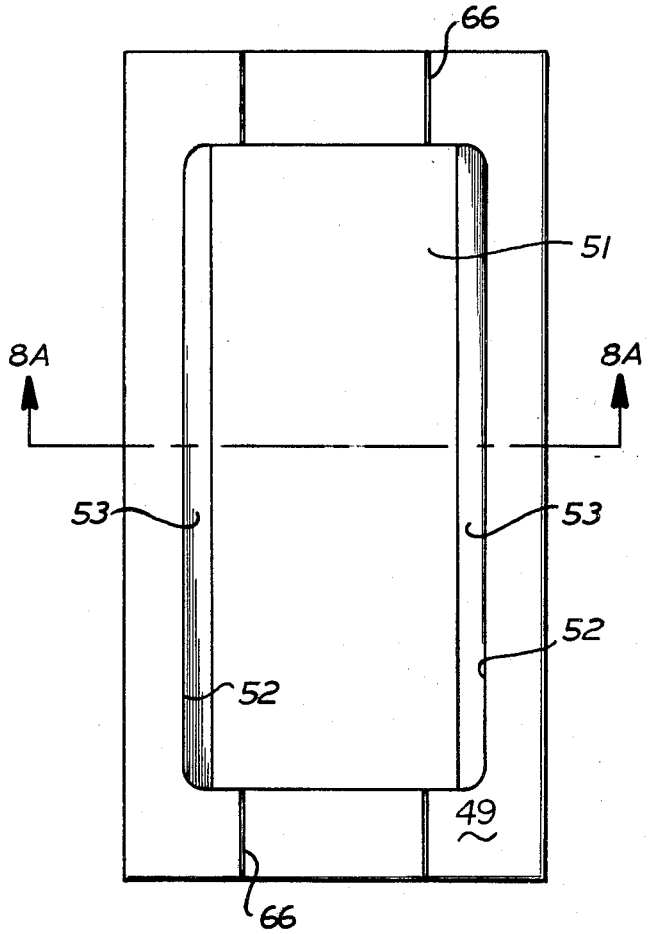
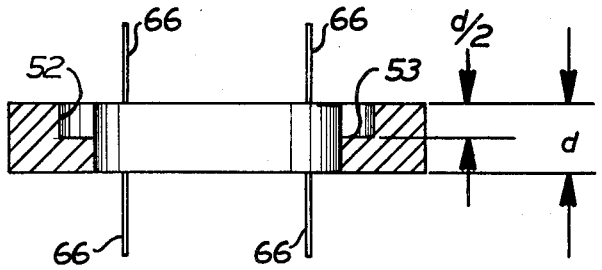
FIG. 8A

FIG.12
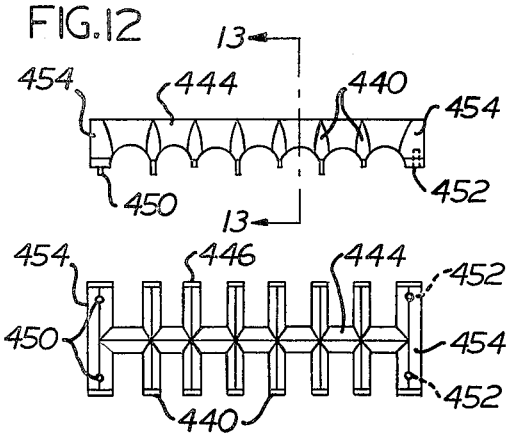
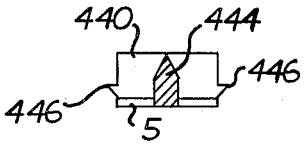
FIG.13
FIG.14
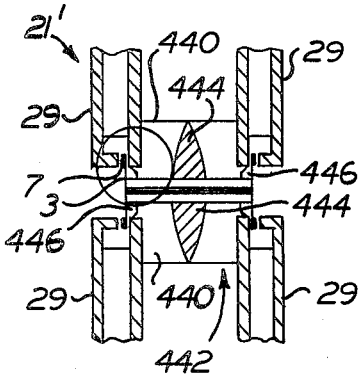
FIG.15
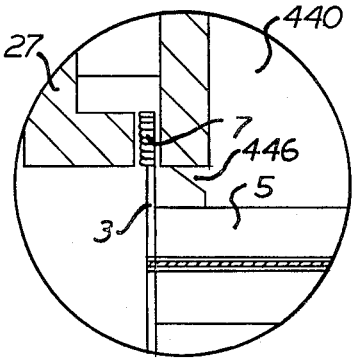
FIG.16
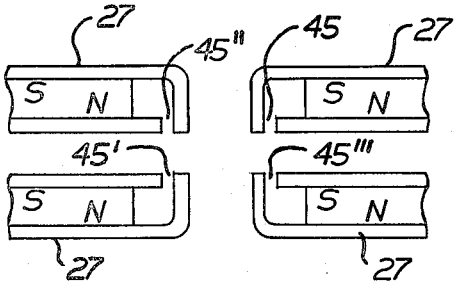
FIG.17
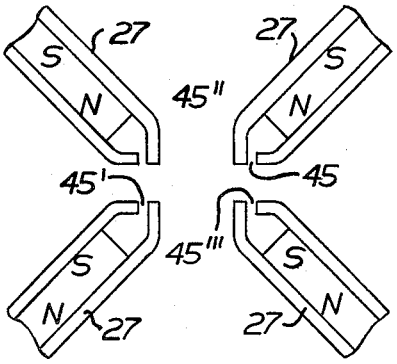
FIG.18

RIGID-DIAPHRAGM TRANSDUCER WITH PLURAL COILS

CROSS REFERENCE TO A RELATED APPLICATION

This is a continuation-in-part of application Ser. No. 42,837, filed May 29, 1979, of Robert W. Necoechea, entitled Rigid Surface Transducer, now abandoned.

BACKGROUND OF THE INVENTION

1. Field of the Invention

This invention relates to electromagnetic transducers and, more particularly to an electroacoustic transducer assembly applicable as an audio speaker.

2. Description of the Prior Art

Various types of electroacoustical transducers also commonly known as sonic transducers, speakers, loudspeakers, audio speakers, etc., are known in the art; the most common and familiar is the conventional cone-type diaphragm which converts the electrical signals from a generating source into compressional air wave signals into the surrounding medium which the listener interprets as audible sound. Cone-type diaphragms accomplish the conversion by creating a vibrational action accompanied by gross flexural warping and bending motions of the diaphragm. These motions inherently introduce distortions during the electromechanical transduction which has led to a shift in the state of the art toward sonic transducers which employ rigid radiating members.

U.S. Pat. No. 4,107,479 to Heil teaches the most recent developments in the state of the art. In Heil a series of spaced diaphragms configured to act as rigid members are interconnected by driver means and adapted to be driven as a unit from a signal generating means.

To date there have been many audio transducers based on achieving rigidity of the diaphragm through corrugation. To date none of these has been successfully manufactured. The commercial failure of these corrugated diaphragm transducers is explained as follows:

1. It is very difficult to wind a coil in a manner such as described by E. Gerlach et al, U.S. Pat. No. 1,934,184, issued Nov. 7, 1933, and keep the long edges straight, or to keep the wires from forming a second layer during the winding process. If the coil is wound in a rectangular shape initially, the wires tend to be improperly spaced along the form. If the coils are wound circularly and formed into a rectangle, it is exceptionally difficult to have parallelism and correct spacing between the two long edges of the coil.

2. The second and more important reason is as follows:

When the diaphragm is driven at its periphery the diaphragm will tend to bow downward at the center when driven upward, and will bow upward at the center when driven downward. This tendency will cause an overall elongation of the diaphragm and a resonant frequency at approximately $f_s/n$; where $f_s$ is the resonant frequency of a single corrugation (with reinforcement ribs included) and where n is the number of corrugations in the diaphragm. Thus the diaphragm cannot be made arbitrarily long and still maintain extended high frequency response, and the advantages claimed for the corrugated surface transducer are lost to the simpler dome radiator.

3. Summary of the Invention

The present invention has features providing advantages over the prior art. The structure of the present invention has the advantage of a rigid diaphragm and yet is compact and efficient. The drive and the single rigid diaphragm in the present invention are intimately associated whereby the ratio of the contact area of the driver means to diaphragm area is much higher than in the prior art, thus developing greater efficiency in converting the driving motion to diaphragm motion without distortion of the diaphragm.

In contrast to the prior art, the coils of the present invention are wound on a tool which controls straightness to any arbitrary degree, insures maximum packing of the conductors and makes scrambled windings impossible for either round or rectangular flat conductors.

The present invention overcomes the second problem stated above in several ways.

1. The corrugated sections are replaced with a reinforced closed surface with a very high primary breakup frequency. (f>2oKhz for a tweeter)

2. The coil is mechanically coupled to the diaphragm such that any tendency toward elongation in the diaphragm sections does not cause an overall elongation of the diaphragm/coil support structure with the concommitant lowering of the primary breakup frequency.

3. The segments of the diaphragm are joined to each other such that there is isolation of the segments.

4. The material between the segments is shaped to allow translation of the segments in the desired direction and is used to form suspension members. Supports are added to the diaphragm frame to which these members are fastened. There is complete independence of segments and hence no lowering of primary breakup frequency. This technique also serves to locate very precisely the coils in the magnetic gaps.

Therefore, it is an object of the present invention to more accurately transduce electrical signals inputted from an audio frequency generator into audible sound.

Another object of the invention is to reduce distortion in audible sound caused by known audio speakers.

Another object of the invention is to more faithfully and accurately reproduce output signals of an audio frequency generator, especially in the high frequency range.

Another object of the invention is to provide an electroacoustic transducer that is basically simple, readily reproducible in manufacture and low in cost.

A further object of the invention is to provide an electroacoustic transducer which produces higher fidelity in audio frequency reproduction.

A further object is to provide a high efficiency electroacoustic transducer which produces higher fidelity in audio frequency reproduction.

These and other objectives, which will become apparent as the invention is described hereafter, are accomplished by an electroacoustic transducer having the combination of: a driver comprising at least two pairs of magnets, the magnets of each pair being spaced apart in one direction a first distance to form a first pair of gaps; each pair of gaps being spaced apart in another direction to form a second gap; a diaphragm and coil support assembly including: a coil support comprising a pair of elongated members spaced apart a distance greater than the second gap; a spirally wound coil on an outside face of each of the elongated members, the end of the coils adapted to be coupled to an electrical signal generating means; a nonflexible non-planar diaphragm member mounted between inside faces of the elongated members; one of the elongated members being located in each of the pair of first gaps; and, the diaphragm being located in the second gap.

BRIEF DESCRIPTION OF THE DRAWINGS

The above said and other objects of the invention will become more apparent in reference to the following description wherein:

FIGS. 4C through 4J illustrate various modified embodiments of the basic closed surface tube of FIGS. 4 and 4A;

FIGS. 4K through 4L show various methods of joining together tube sections, alternative to that illustrated in FIGS. 4 and 4A;

FIG. 4M shows a variation in suspension compatible with the diaphragm shown in FIG. 4A;

FIG. 5B is a perspective view of a half-section of a diaphragm/coil support compatible with the diaphragm of FIG. 4A;

FIGS. 5C and 5D show a modified coil/diaphragm support compatible with the diaphragm shown in FIG. 4A;

FIG. 6A is a plan view of a diaphragm/coil support showing the diaphragm (edge) in position and coil in position;

FIG. 6B is a cross-sectional view of the coil support taken along lines 6B—6B of FIG. 6A;

FIG. 7 is a perspective view of a diaphragm/coil support showing the flat wire coil in position;

FIG. 8 is an orthogonal projection of the diaphragm-/coil support assembly carrier frame;

FIG. 8A is a cross-sectional view of the diaphragm-/coil support assembly carrier frame taken along line C—C of FIG. 8;

FIG. 12 is a side elevational view showing the diaphragm/coil support subassembly half of FIG. 11;

FIG. 13 is a sectional view taken generally along the line 13—13 of FIG. 12;

FIG. 14 is a top plan view showing the diaphragm-/coil support subassembly half of FIGS. 12 and 13;

FIG. 15 is a fragmentary view taken in horizontal section showing in assembled mode the embodiment of FIGS. 11-14;

FIG. 16 is an enlarged, detail view of the circled portion of FIG. 15;

FIG. 17 is a fragmentary, schematic plan view showing a modified embodiment of driver subassembly magnet arrangement;

FIG. 18 is a fragmentary, schematic plan view similar to FIG. 17 but showing yet another embodiment of a driver subassembly magnet arrangement.

DESCRIPTION OF THE PREFERRED EMBODIMENTS

Figure 1:
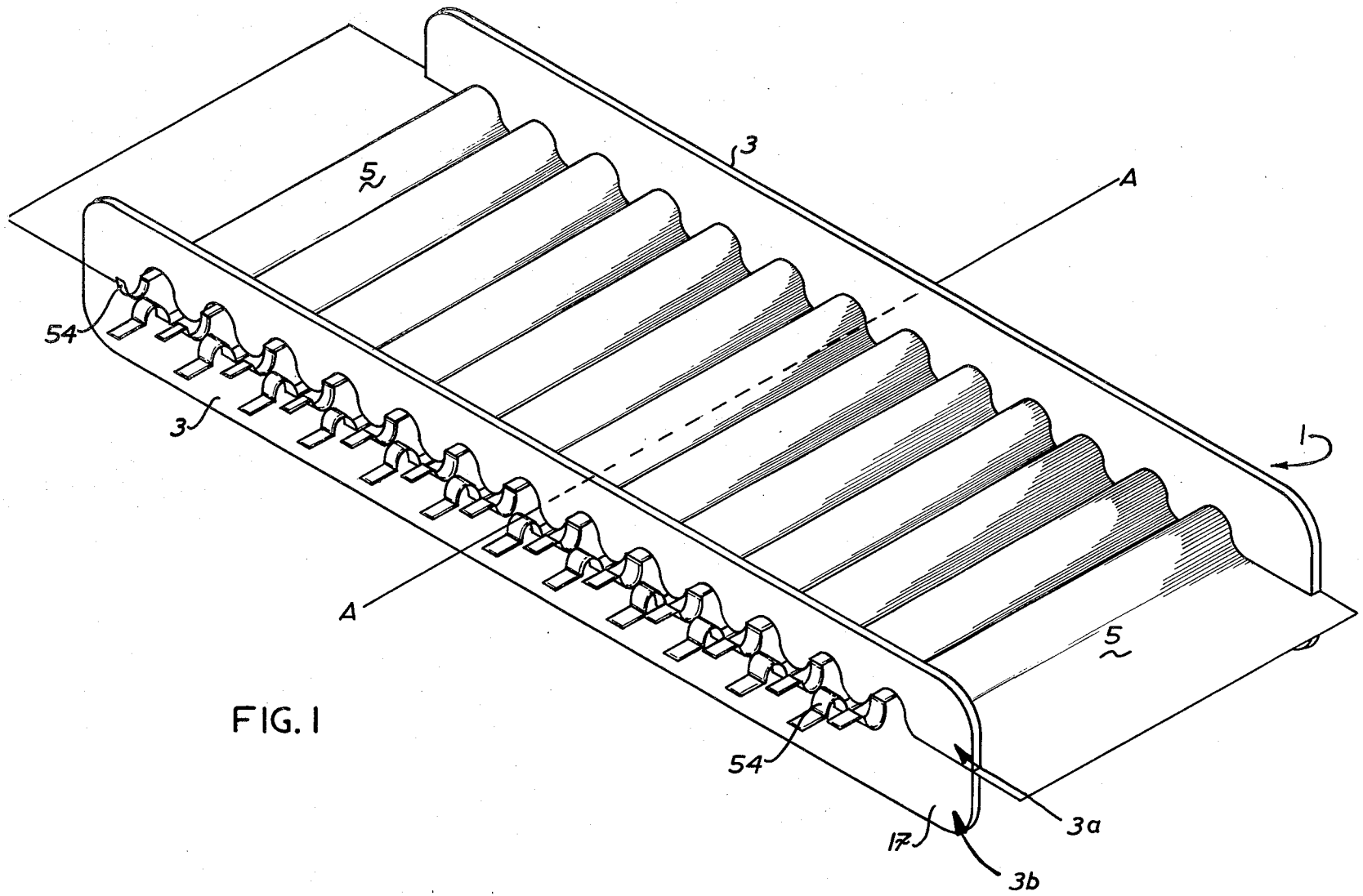
FIG. 1 is a perspective view of one form at the diaphragm/coil support assembly.

FIG. 1 shows a typical embodiment of the diaphragm and coil support assembly 1, which includes a diaphragm 5 and two coil support members.

Typically the diaphragm 5 is constructed of a material which has a high modulus of elasticity, plus a high tensile modulus to mass ratio and thus has a high sound transmission velocity. Aluminium provides a suitable diaphragm material. Boron, beryllium and graphite are other suitable materials being very high modulus of elasticity materials which are more advantageous but are far more expensive.

Figure 4:
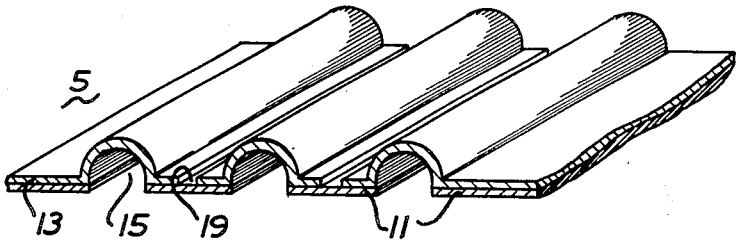
FIG. 4 is a perspective view of a half-section of a diaphragm according to the invention.
Figure 4A:
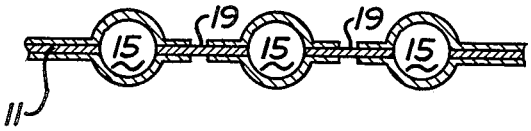
FIG. 4A is a schematic end view of FIG. 4 in complete section.

Diaphragm 5 is constructed to be non-planar. In addition to the form of diaphragm 5 shown in FIG. 1, alternate forms of the diaphragm are shown in FIGS. 4 and 4A. Each alternate type diaphragm 5 as shown in FIG. 4 consists of two geometrically mirror image halves. Typically each half consists of aluminium of a thickness in the range of 0.3 to 1 mil; the preferred thickness being 0.7 mil; for high frequency reproduction and a thickness of 3 to 5 mil for lower frequency reproduction. The halves are bonded together by a thin layer 11 of low Q material such as polyethylene. The advantage of the use of said low Q material is understood by considering the diaphragm action. Considering a diaphragm of the configuration of FIG. 4A when two such halves are mated properly, a diaphragm flat section 13 is formed between adjacent diaphragm tubes 15; the polyethylene bonding being in said flat sections 13. A gap 19 is provided in the flat sections 13 to decouple adjacent tubes. Along the entire length of the tube 15 any distortion in the cross-sectional shape of any one tube 15 when the diaphragm 5 is being driven does not produce any distortion of any other tube of the diaphragm 5. Therefore it has been found that even above 20 kHz where tube resonance occurs, there is no tendency to cause interaction between adjacent sections of the diaphragm 5.

As a pratical matter many other materials could be used to bond the diaphragm 5 halves together but the advantages supra of using a very light, low Q material would be lost. In any embodiment the diaphragm shape is to be non-planar.

In all of the different forms of the diaphragm of the present invention it is essential that the diaphragm be of low mass. This overcomes problems of inertia and the power required to move the diaphragm so as to obtain greater high frequency response.

Figure 5A:
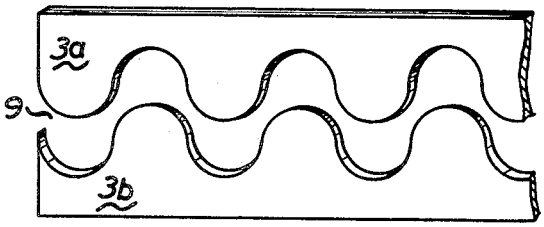
FIG. 5A is a perspective view of a diaphragm/coil support compatible with the diaphragm of FIG. 4B.

FIGS. 5A and 5B show various diaphragm/coil support 1 embodiments. In FIG. 6 and 7 typical coil supports 3 are shown with the coils 7 attached.

A typical coil 7 winding is illustrated. The coil 7 is wound using flat conductor, termed a "flat wire" in the industry, in a rectangular spiral with the wires layered in a flat-to-flat configuration to form a stack for mounting on the outside faces 17 of the diaphragm/coil support. The coil 7 can be formed in a typical process of winding flat-to-flat, then curing with clamps along the flats of the outermost layers to densely pack the conductor coils. Note in FIG. 6A that in a mounted coil 7 the current i flows from left to right with coil 7 on the upper half 3*a* of coil support 3 and from right to left in the coil 7 on the lower half 3*b* of coil support 3.

Figure 4B:
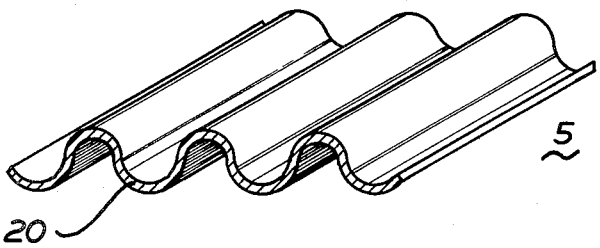
FIG. 4B is a perspective view of a diaphragm.

The coil supports 3 perform the additional task of providing suspension members 54 for the diaphragm 5 as best shown in FIG. 1. The coil support 3 is in two halves 3*a* and 3*b* with a sandwiching slot 9 therebetween for the diaphragm. Thereby, the coil support 3 keeps the diaphragm rigid along its edges 20 in FIG. 4B where same are sandwiched when slot 9 is closed and bonded. The coil support can be formed of metal or a high temperature resistant plastic material.

The result of the corrugated diaphragm 5 with the edges rigidified in the closed slot 9 is that the diaphragm is resistant to a bowing type movement in the transverse direction.

Figure 2:
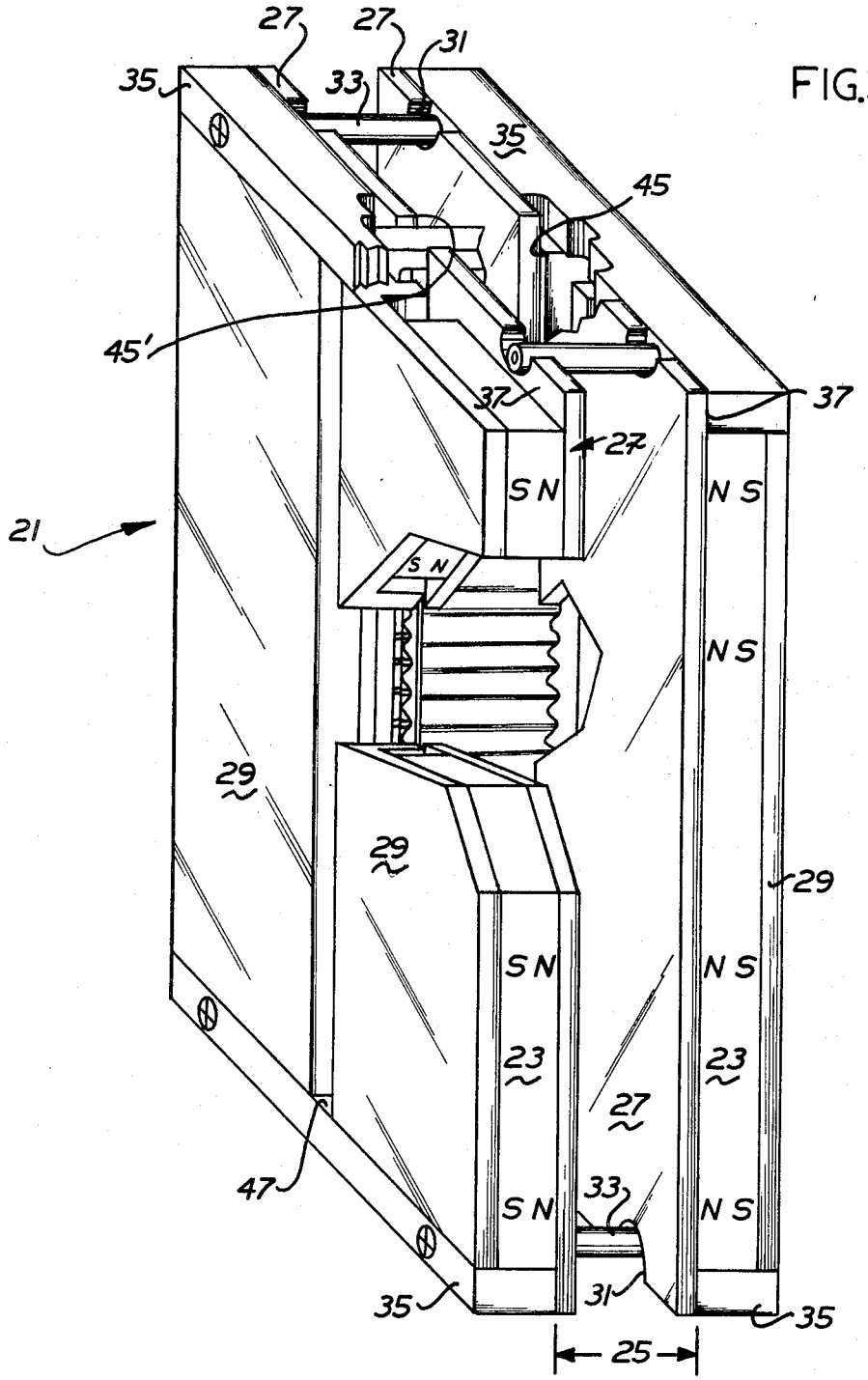
FIG. 2 is a perspective view of the magnet driver assembly housing, with the diaphragm/coil support assembly inserted therein.

In FIG. 2 the typical driver subassembly 21 into which diaphragm/coil support subassembly 1 is inserted is illustrated. Four permanent magnets 23 are used in the preferred embodiments. The magnets in the rearward section of the subassembly 21 though not shown are oriented symmetrically with those shown only with reverse polarity in the magnetic alignment; viz. S polarity in toward acoustical aperture or gap 25 and N polarity facing out away from gap 25. Magnets 23 may be typical ferrite magnets.

An inner pole piece 27 and an outer pole piece 29 are associated with each of the magnets 23. The pole pieces may be constructed of soft iron. The inner pole pieces 27 are rectangularly shaped with two spacer channels 31 located in each; the pairs of channels 31 being located diametrically opposed to each other in each inner pole piece 27 to allow for passage of a precision spacer 33 therethrough. The spacers 33 are threaded, precision machined, non-magnetic bars the length of which determine the critical dimension of gap 25 spacing as shown in FIG. 2.

Figure 3:
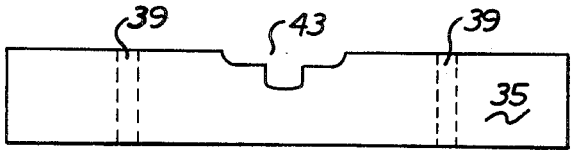
FIG. 3 is a plan view of the magnet assembly alignment member.

The permanent magnets 23 and pole pieces 27, 29 are held in place by four brackets 35 which span the outer pole pieces 29 and abut the inner pole pieces 27 at inner pole piece outer face 37. The brackets 35 are shown in perspective as engaged in the driver subassembly 21 in FIG. 2 and from a top view in FIG. 3.

Each bracket 35 is generally rectangular in shape. Each bracket 35 has two bores 39 extending completely therethrough for insertion of said screws which hold precision spacers 33. The bracket 35 may be, for example, machined aluminium bar-stock, a die casting or an injection molded part. Various alternatives to such arrangement are obvious, for threaded arrangement wherein a threader spacer or nut and bolt type spacer is conceived a counterbore (not shown) may be included in bracket 35 for flush mounting.

Bracket 35 also includes an indentation groove 43 (FIG. 3) which regulates the position of the diaphragm-/coil support assembly 1 when assembly 1 is inserted into the driver subassembly 21.

As shown in FIG. 2, outer pole pieces 29 are of an L-shaped configuration. When in position, the inner 27 and outer 29 pole pieces from a magnetic gap 45 therebetween. The outer pole pieces 29 form an air gap 47 between adjacent pieces 29. The gap 45 is referred to hereinafter as the magnetic gap 45, and is approximately 0.030 inches thick for a high frequency device. This is a precision dimension set by fixturing individual magnet subassemblies (29, 23, 27).

To form an operable electroacoustic transducer, the magnets 23, pole pieces 27, 29, brackets 35 are arranged and fastened together by the precision spacers 33 in order to form a uniform precision gap spacing between the outer surfaces of the pole pieces. The gap 25 spacing precision should conform to standard industry practices. As a practical matter, bar magnets such as generically named Ferrox 5A, sintered $BaFeO_3$ permanent magnets may be employed in construction of the driver subassembly 21. Such material is marketed by the Indiana General Company under the tradename "Indox 5A."

The diaphragm/coil support subassembly 1 with coils 7 in place can then be inserted into the driver subassembly 21. To accomplish this a carrier frame 49 for the diaphragm/coil support subassembly 1 is employed. The frame 49 shown is for a diaphragm of the configuration shown in FIG. 4A and B.

FIGS. 8 and 8A show details of the frame 49. The frame is generally rectangular in form having a width and thickness so as to have a sliding friction fit in grooves 43 in the opposed brackets 35 as shown in FIG. 2. The interior of the frame 49 is provided with an opening 51 large enough to enclose the coil-diaphragm subassembly 1 but with the assembly 1 spaced from the interior edges of the opening 51. Opposed interior edges 52 of the opening 51 have recesses 53 extending longitudinally along the edges 52. The recesses 53 have a depth about one-half the thickness of the frame 49.

The coil-diaphragm assembly 1 is movably mounted in the opening 51 by securing the tabs 54 in the recesses 53. The tabs can be extensions of one or both of the flexible members making up the diaphragm and can be secured in the recesses 53 by any suitable adhesive.

While the tabs 54 are shown, any equivalent mounting means permitting movable support for the assembly 1 in the opening 51 could be used.

Eight tabs 66 shown in FIG. 8 make a frictional contact with the outer surfaces 37 of the inner pole piece 27 in the vicinity of the gaps 45 thereby precisely aligning the coils 7 and coil supports 3.

In operation, the framed, diaphragm/coil support assembly 1 being installed into the driver subassembly 21, the audio speaker action is one of linear translational transduction.

As is seen in FIG. 6A, if the current in the portion of the coil 7 above the diaphragm 5 flows in one direction, the current in the portion of the coil 7 below the diaphragm 5 necessarily flows in the opposite direction.

Figure 10:
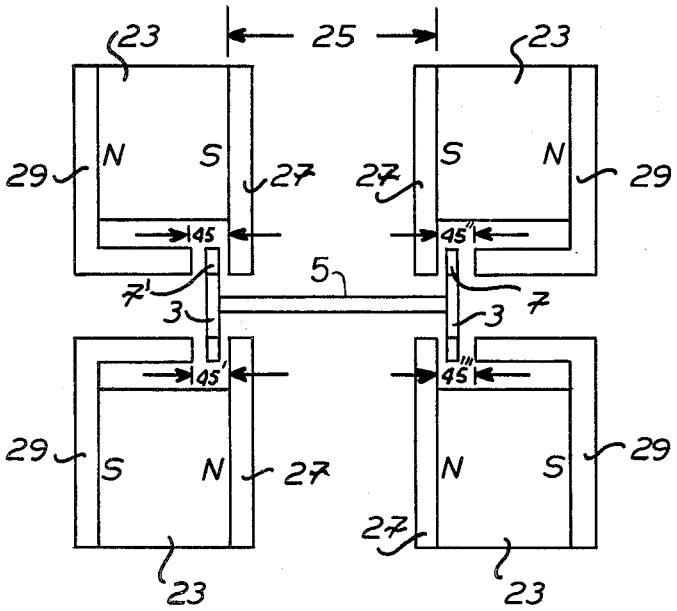
FIG. 10 is a schematic top view representation of the driver assembly of FIG. 2 with the diaphragm/coil support assembly of FIG. 1 in operative placement.

FIG. 10 is a schematic top view of FIG. 2. The frame 49 has been omitted from this view for clarity. Note that the diaphragm/coil assembly 1 shown here utilizes two independent coils 7 and 7'. One coil 7 is located in gaps 45'' and 45''' while the other coil 7' is located in gaps 45 and 45'. As shown the flux in gaps 45'' and 45' is from right to left and the flux in gaps 45 and 45''' is from left to right. Thus, if the current in the portion of the coil 7 located in gap 45''' is directed into the page the resultant force on the diaphragm 5 is toward the bottom of the page. As illustrated in FIG. 6A the current in the portion of the coil 7 located in gap 45'' is then directed out of the page and the resultant force on the diaphragm 5 is toward the bottom of the page. The coil 7' is wired either in series with or parallel to coil 7 such that the current through the portion of the coil 7' located in gap 45 is directed into the page, while the current through the portion of the coil 7' located in gap 45' is out of the page. Thus the resultant force on the diaphragm 5 due to the current in each of the four gaps 45, 45', 45'' and 45''' is toward the bottom of the page for current in the direction indicated above. When the current direction reverses the resultant force on the diaphragm is toward the top of the page. It should be noted that top and bottom refer only to orientation of the drawing on the page. In typical operation the transducer would be oriented as in FIG. 2 and the motion of the diaphragm 5 would be alternately toward and away from the listener.

Additionally, the coils in gaps 45 and 45″ are pulling diaphragm 5 when the coils in gaps 45′ and 45‴ are pushing diaphragm 5, thus cancelling most assymmetries in the magnetic fields and further reducing even order harmonic distortions.

As the assembly 1 is accelerated there is a tendency for the diaphragm 5 to elongate. This tendency is countered by the tensions thus produced in the sandwiching coil support 3 along its lengthwise direction. There is then a resonant frequency set up proportional to the elastic modulus of the material used to construct the coil support 3 and the mass of assembly 1. One method of minimizing the resonance to a point of virtual elimination is to raise the frequency at which such resonance occurs. This is accomplished by making a non-planar sectional type diaphragm as shown in FIG. 4A. The diaphragm 5 is joined to the coil support 3 along the edges 61 in FIG. 5B and not in the void section space 63. Rigidity is achieved because the support forks 65 which culminate in edges 61 resist any tendency of the tube section 15 of the diaphragm 5 from deforming out-of-round. The meaning of "rigid" in this case is that the diaphragm 5 itself does not bend or flex. By virtue of being mounted to a frame by flexible members such as 54 in FIG. 1, the diaphragm/coil support assembly 1 is able to undergo translation as a whole and in that sense vibrate. It does not vibrate in the sense that one point on the diaphragm surface moves relative to any other point on the diaphragm surface. Thus, "rigid" as it applies to a surface is intended to denote that points on the surface do not move relative to each other during operation. The void sections 63 of coil support 3 allow the fork sections 65 to flex without causing a general elongation of the diaphragm assembly. Since there is no coupling of the tube section 15 flexing to the elongation of the diaphragm 5, the lowest resonant frequency is above 20 kHz., for example, in a one inch long tubed section with a one-eighth inch diameter using 0.0005 inch thick aluminium.

Reinforcing ribs (not shown) may be inserted along the length of the diaphragm 5. The ribs would contact the diaphragm 5 in the same manner as the coil support 3. The function of such ribs would be to further inhibit flexing of the diaphragm 5. This would allow a wider diaphragm 5 which would still preserve the high frequency response capabilities of the narrow diaphragms shown.

The basic closed surface is a tube. This can be formed by joining two half sections with a suitable, known bonding material 11 as shown in FIG. 4A, or by forming a tube 410 with a very thin wall (FIG. 4C) as by vapor deposition, electroless plating, electroplating, or compression molding. FIG. 4D shows mechanical bonding of a sheet to form a tube 412. These tubes are then made rigid by an inner reinforcement disk or outer reinforcement rib, such as disk 414 in FIGS. 4E and 4F, or rib 416 in FIGS. 4G and 4H. (Note: material thicknesses in FIGS. 4C through 4H are not shown to scale.)

Another possible reinforcement member would be a semisphere such as seen in FIGS. 4I and 4J, where concave disk 418 and convex disk 420 are shown, respectively. For most applications, these ribs or disks would be incorporated into the structure of the coil/diaphragm support. See FIGS. 5C and 5D. Note facility for overlapping portions of ribs 422,424. This is similar to what is shown in FIG. 5B except for the overlap.

FIGS. 4 and 4A show one method of joining tubular sections such that a high degree of insolation is maintained. Variations are shown in FIGS. 4K through 4M. In the variation seen in FIG. 4K, the diaphragm is made from two complementary sheets 426, 428 of high modulus material joined and shaped as shown. In this case, isolation of the sections is achieved by the slight "s" shape in the material between the tubes.

A second variation, as seen in FIG. 4L, would be to incorporate this "s" shape in the low Q sections of the diaphragm shown in FIG. 4A. This increases the isolation beyond either of the previous configurations. Sections 430 and 432 are high Q, high modulus material, while section 434 is a low Q, low modulus of elasticity material, where, as is known, Q is the ratio of energy stored to energy lost per cycle.

The configuration shown in FIG. 4M has a material 436 disposed between the tubular segments 438, this material being a low Q material such as, for example, polyethelyene. Note that this low Q material 436 is shown held in place by the diaphragm supports 440 such as that the behavior of each segment is totally independent from that of the others. The frame for this structure is two pieces of cast material, such as a synthetic resin, zinc, or aluminium, which sandwiches the diaphragm. The frame half section is shown more completely in FIGS. 12 through 14.

Figure 9:
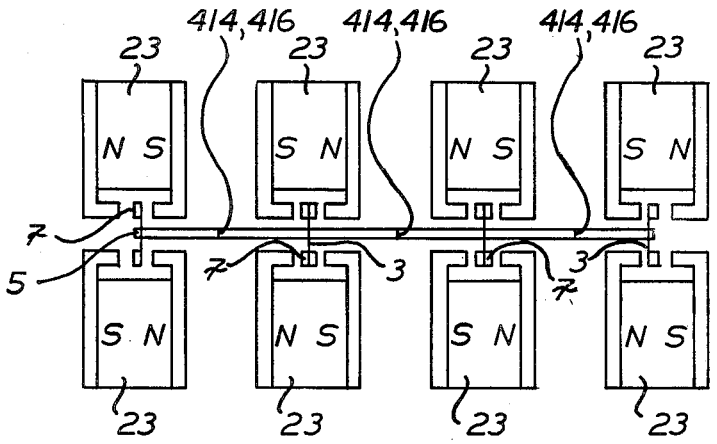
FIG. 9 is a schematic view of an extended diaphragm alternate embodiment of the assembly.

FIG. 9 schematically shows a device with multiple coil/coil supports 3 across a wide diaphragm 5. The diaphragm 5 is shown with internal reinforcement ribs or discs 414, 416 allowing the coil/coil support assemblies to be located farther apart. Note also that the two central coil/coil support assemblies have a coil 7 on each side of the support 3. This is to maintain equal drive of the diaphragm 5 for each section.

Figure 11:
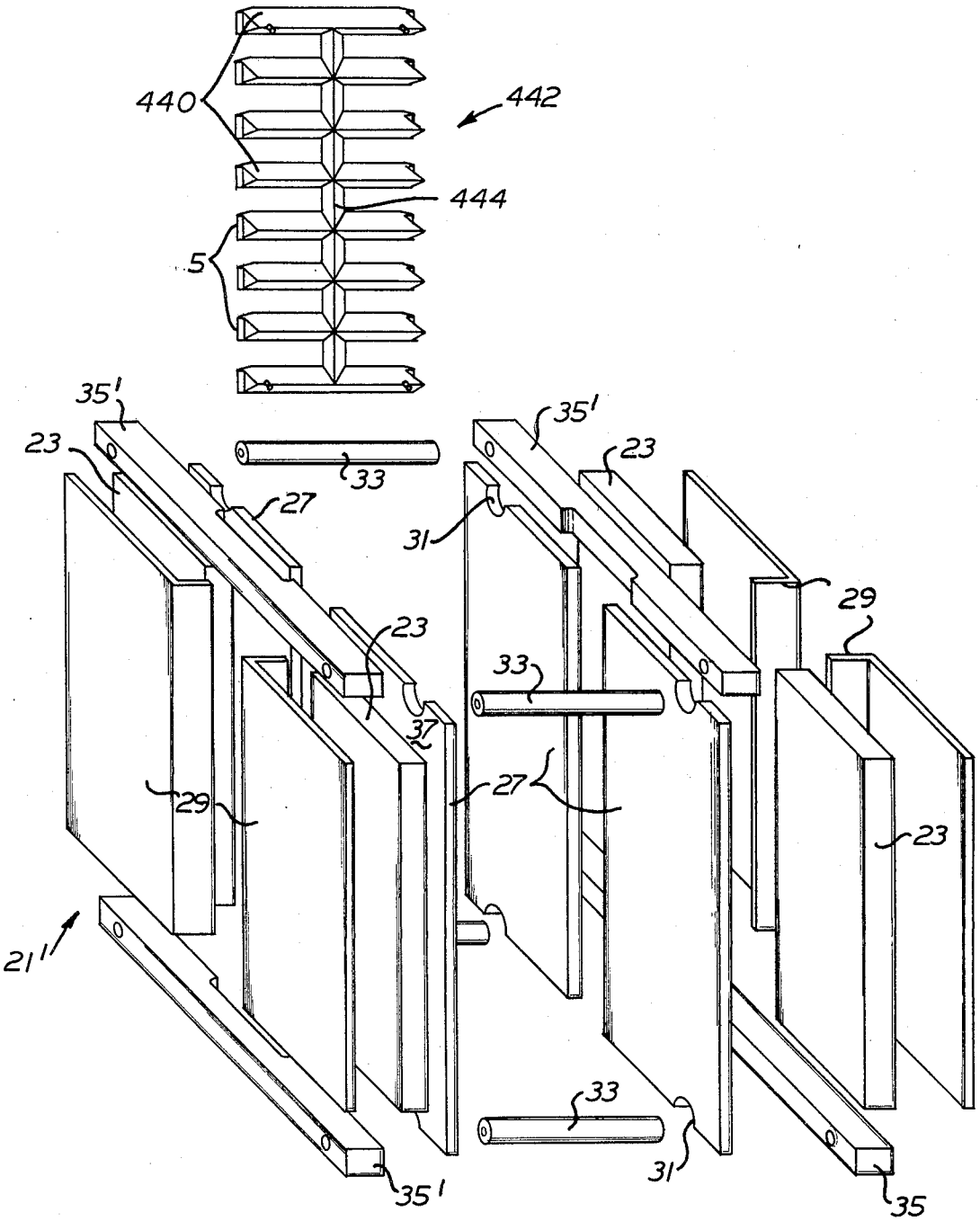
FIG. 11 is an exploded perspective view showing a modified embodiment of the invention, with some parts missing.

In this embodiment the permanent magnets are a ferrite type and the pole pieces are soft iron. Each assembly is capable of being magnetized separately without any loss in energy and with a simple magnetizing coil. FIG. 11 shows an exploded perspective view of a diaphragm and coil support assembly frame half 442 and driver subassembly 21′ combination. See FIG. 4M for the details of the relationship of the diaphragm to the frame. The only significant difference between subassembly 21′ and subassembly 21 is the elimination of the indentation groove in brackets 35′ to receive assembly frame half 442, as required in the manner of assembly 1 in grooves 43 (FIG. 2). The coils 7 extended continuously along the sides of assembly frame half 442 as seen in FIGS. 15 and 16, but have been removed from FIG. 11 for clarity.

In FIGS. 12 through 14, the beam 444 interconnects all the diaphragm supports 440 which are shown in FIG. 4M. The protrusions 446 are used to locate the diaphragm in the direction parallel to the translation of the diaphragm. FIGS. 15 and 16 illustrate this. Note that 446 protrudes and locates the diaphragm vertically while diaphragm support 440 locates the frame/coil/coil support/diaphragm assembly relative to gaps of the driver assembly. Normally, the transducer is operated so that vertically above in FIGS. 15 and 16 is actually front-to-back. A coil 7 is mounted on supports 3 of diaphragm 5 in the manner of FIGS. 6A, 6B, 7 and 10.

Pins 450 engage sockets 452 to hold a pair of assembly frame halves 442 to join same in alignment, as seen in FIGS. 15 and 16. End portions 454 terminate the support assembly halves so as to bracket supports 440, six supports 440 per assembly being shown.

While the magnet structure shown in FIGS. 2 and 10 are the preferred embodiment, several alternate structures are possible, examples of which are shown in FIGS. 17 and 18. Note, however, that all the magnetic gaps remain the same (placement, size, spacing). The magnets and pole pieces in FIG. 17 are repositioned to achieve a shallower, but wider, structure. In FIG. 18, the gap placement, size and spacing remain the same however the pole pieces are configured to allow a horn effect on the front and rear (top and bottom as shown in FIG. 18). For both of these configurations, a locating bracket may be configured similar to that in FIG. 3, which fixes the relative positions of the inner pole pieces 27 while allowing the diaphragm to slip easily into place with the coils/coil supports properly positioned in the gaps. The use of samaruim cabalt magnets greatly reduces the size of the magnet structure and is fully compatible with any of the configurations shown by merely shrinking the magnets and corresponding pole pieces.

The entire assembled audio transducer heretofore described can be mounted in an aesthetically appealing housing as are conventional loudspeakers.

While the invention has been described with reference to the above disclosure relating to preferred embodiments, it is understood that numerous modifications or alterations may be made by those skilled in the art without departing from the scope and spirit of the invention as set forth.

What I claim is:

1. In an electroacoustic transducer, the combination comprising:

A. drives means including at least two magnet assemblies each providing a pair of opposed magnetic gaps therein, said magnet assemblies being spaced from one another a distance to form an acoustical gap; and B. a diaphragm and coil support assembly arrangeable in the magnetic and acoustical gaps of the driver means and including:

(1) coil support means comprising a pair of elongated members spaced apart a distance greater than said acoustical gap;

(2) a spirally wound coil on each of said elongated members, the ends of said coils adapted to be coupled to electrical signal generating means; and (3) a non-flexible non-planar diaphragm mounted on and arranged to extend between said elongated members, one of said elongated members being located in each of said pair of magnetic gaps and said diaphragm being located in said acoustical gap.

2. Apparatus as set forth in claim 1, wherein each magnet assembly comprises a pair of magnets with an air gap therebetween.

3. Apparatus as set forth in claim 1, wherein said spirally wound coil comprises flat conductor, wound flat-to-flat in a substantially rectangular orientation.

4. Apparatus as set forth in claim 1, including a carrier frame mounting said diaphragm and coil support assembly therein.

5. Apparatus as set forth in claim 4, including a housing, said two magnet assemblies being mounted in said housing; locating means arranged in said housing for engaging said frame and positioning said diaphragm and coil support assembly relative to said two magnet assemblies in a predetermined manner.

6. Apparatus as set forth in claim 1, wherein each said elongated member of said coil support means comprises a pair of elongated elements mated along a common border, the configuration of said common border determining the shape of said non-planar diaphragm member in longitudinal section.

7. Apparatus as set forth in claim 6, wherein the configuration of said common border has a corrugated shape.

8. Apparatus as set forth in claim 6, wherein the configuration of each element at said common border comprises pairs of forked members forming pairs of semicircular openings separated by gaps, said pairs of forked members of each element mating with the forked members on the other element to form circular openings alternating with gaps.

9. Apparatus as set forth in claim 6, wherein said diaphragm member comprises two sheets of flexible material bonded together with closed sufaces therebetween to form a rigid structure.

10. Apparatus as set forth in claim 9, wherein said cross-sectional configuration of said diaphragm member is a corrugated shape.

11. Apparatus as set forth in claim 9, wherein said cross-sectional configuration of said diaphragm member comprises a linear series of interconnected circles.

12. Apparatus as set forth in claim 9, wherein said diaphragm member comprises a series of hollow tubes interconnected by flat web elements.

13. Apparatus as set forth in claim 9, wherein the diaphragm member sheets are formed of aluminium foil.

14. Apparatus as set forth in claim 13, wherein said foil has a thickness of approximately 0.3 to 1 mil.

15. Apparatus as set forth in claim 13, wherein said foil has a thickness of approximately 3 to 5 mil.

16. Apparatus as set forth in claim 9, wherein the bond is formed by a low Q material such as polyethylene.

17. Apparatus as set forth in claim 4, including mounting means mounting said diaphragm and coil assembly in said frame, whereby said assembly is capable of movement relative to said frame.

18. Apparatus as set forth in claim 17, wherein said assembly forms means for permitting unitary linear translational movement relative to said frame, whereby there is no distortion of the diaphragm member.

19. Apparatus as set forth in claim 1, wherein said diaphragm and coil support assembly is symmetrical with respect to each of the three orthogonal planes which can be cut through the geometric center point of said assembly.

20. Apparatus as set forth in claim 1, wherein the diaphragm and coil support assembly includes a pair of assembly halves, each comprising a plurality of coextensive, longitudinally extending, substantially parallel, diaphragm frame support elements, and a beam connecting together the support elements, each of the support elements being provided with a protrusion arranged for locating the diaphragm in said acoustical gap and relative to said magnetic gaps of the driver means.

21. A diaphragm and coil support assembly for an electroacoustic transducer, comprising in combination:

A. a planar carrier frame having an elongated rectangular opening therein;

B. coil support means comprising a pair of elongated substantially flat members positioned in spaced apart parallel relationship in said rectangular opening in respective planes perpendicular to the plane of said carrier frame, each said elongated member being formed of two substantially flat parts mated together edgewise along a longitudinally extending common border;

C. a diaphragm positioned between said spaced elongated members in substantially the plane of said carrier frame, said diaphragm being supported between said mated parts of each elongated member along the respective common borders, said diaphragm being non-flexible and non-planar;

D. means for interconnecting said coil support means and diaphragm therebetween with said carrier frame and permitting relative movement therebetween; and E. a spirally wound coil on an outside face of each of said elongated members, the ends of said coils adapted to be coupled to an electrical signal generating means.

22. An assembly as set forth in claim 21, wherein said diaphragm is formed from sheets of flexible material bonded together in a predetermined cross-sectional configuration and supported by said elongated members to form a rigid structure.

23. An assembly as set forth in claim 22, wherein the cross-sectional configuration of said diaphragm is a corrugated shape.

24. An assembly as set forth in claim 22, wherein the cross-sectional configuration of said diaphragm comprises a linear series of circles interconnected by straight portions.

25. An assembly as set forth in claim 22, wherein said diaphragm comprises a series of interconnected hollow tubes.

26. An assembly as set forth in claim 22, wherein said diaphragm sheets are formed of aluminium foil.

27. An assembly as set forth in claim 26, wherein said foil has a thickness of approximately 0.3 to 1 mil.

28. An assembly as set forth in claim 26, wherein said foil has a thickness of approximately 3 to 5 mil.

29. An assembly as set forth in claim 21, wherein the diaphragm includes a plurality of coextensive substantially parallel, hollow tubes constructed from a material having a high modulus, the tubes being connected to one another by a means for isolating the tubes from one another.

30. An assembly as set forth in claim 29, wherein the carrier frame includes diaphragm frame supports attached to the means for isolating the tubes for holding the means for isolating in place.

31. An assembly as set forth in claim 29, wherein the carrier frame includes diaphragm frame supports attached to the means for isolating the tubes for suspending the diaphragm assembly to allow for linear translation.

* * * * *